US006443207B1

(12) United States Patent
Cheng et al.

(10) Patent No.: US 6,443,207 B1
(45) Date of Patent: Sep. 3, 2002

(54) WINDOW COVERING ADJUSTMENT APPARATUS AND METHOD

(75) Inventors: Li-Ming Cheng, Kaohsiung (TW); Lawrence S. Wu, Rowland Heights, CA (US)

(73) Assignee: Zipshade Industrial (B.V.I.) Corp., Rowland Heights, CA (US)

( * ) Notice: Subject to any disclaimer, the term of this patent is extended or adjusted under 35 U.S.C. 154(b) by 0 days.

(21) Appl. No.: 09/871,361

(22) Filed: May 30, 2001

(51) Int. Cl.[7] ..... E06B 9/48
(52) U.S. Cl. ..... 160/84.04; 160/178.1 R
(58) Field of Search ..... 160/173 R, 168.1 R, 160/167 R, 178.1 R

(56) References Cited

U.S. PATENT DOCUMENTS 2,486,492 A * 11/1949 Redman
2,546,534 A * 3/1951 Znidarsic
2,618,329 A * 11/1952 Nelson
2,624,086 A * 1/1953 Schaefer
2,697,487 A * 12/1954 Nelson
2,874,612 A 2/1959 Luboshez
4,673,018 A * 6/1987 Judkins
5,158,127 A 10/1992 Schumacher
5,918,656 A * 7/1999 Daniels et al.
5,947,176 A * 9/1999 Judkins
6,059,004 A * 5/2000 Oskam
6,131,640 A * 10/2000 Judkins

* cited by examiner

*Primary Examiner*—Blair M. Johnson
(74) *Attorney, Agent, or Firm*—William W. Haefliger

(57) ABSTRACT

A method of controlling the vertical height of a window shade having a top and bottom, which includes providing shade upper support structure at or proximate the shade top; providing at least one substantially vertically elongated shade support line extending downwardly from the upper support structure, and providing shade lower support structure at or proximate the shade bottom; elevating or lowering the shade lower support structure relative to one or more support lines; and securing the shade lower support structure to the line or lines at a selected height position relative to the line length above the lower support structure, whereby the height of the shade bottom can be quickly manually adjusted by adjustment of the height of the shade lower support structure effective securement to line or lines.

9 Claims, 3 Drawing Sheets

WINDOW COVERING ADJUSTMENT APPARATUS AND METHOD

BACKGROUND OF THE INVENTION

This invention relates generally to control or adjustment of window coverings, and more particularly to ease and efficiency of window covering height adjustment. Such coverings are referred to as shades, and may be formed by pleats of a single piece of material, or by other configuration.

There is need for improvements in adjustability of such coverings or shades, as for example where the effective window covering height of the shade is to be adjusted. In the past, pleated shades were suspended by their own material, i.e. were allowed to hang, causing the weight of the shade to expand the pleats. It was then difficult to accurately adjust shade height, since over time the shade weight could expand the pleats, changing the overall height of the shade. Such pleated shades typically consisted of paper.

SUMMARY OF THE INVENTION

It is a major object of the invention to provide an easily adjustable means allowing shade height adjustment, and where only a minimum number of shade supporting lines are required.

Basically, the improved means comprises a) upper support structure at or proximate the shade top, b) at least one substantially vertically elongated shade support line extending downwardly from said upper support structure, c) shade lower support structure at or proximate the shade bottom, and shade adjustment includes:

d) elevating or lowering the shade lower support structure relative to the one or more support lines, e) and effectively securing the shade lower support structure to the line or lines at a selected height position relative to the line length, f) whereby the height of the shade bottom can be quickly manually adjusted by adjustment of the height of the shade lower support structure effective securement to the line or lines.

As will appear, the shade is typically provided in the form of a sequence of pleats, and the line or lines is or are located adjacent such pleats.

Another object includes provision for weight of the lowermost extent of the shade to be carried by the shade lower support structure as that lower support structure is elevated to shorten the height of the shade. As the shade lower support structure is adjusted upwardly, the dangling lower line below that support structure is typically supported to extend laterally and by the lowermost support structure, which may include a horizontal slat.

A further object is to provide attachment shoulders on the horizontal slat, to be engaged by the lower line; and such shoulders may be in the form of horizontally spaced slots in the slat.

The height adjustment of the lower support slat relative to the support line or lines may include provisions of a line gripping stop, which can be moved upwardly and downwardly along the line to selected line gripping positions. The slat is then supported by the stop. Alternatively, the line can simply be allowed to pass through a hole in the slat, and the line is then turned laterally for attachment to the slat, as referred to.

These and other objects and advantages of the invention, as well as the details of an illustrative embodiment, will be more fully understood from the following specification and drawings, in which:

DRAWING DESCRIPTION

DETAILED DESCRIPTION

Figure 1:
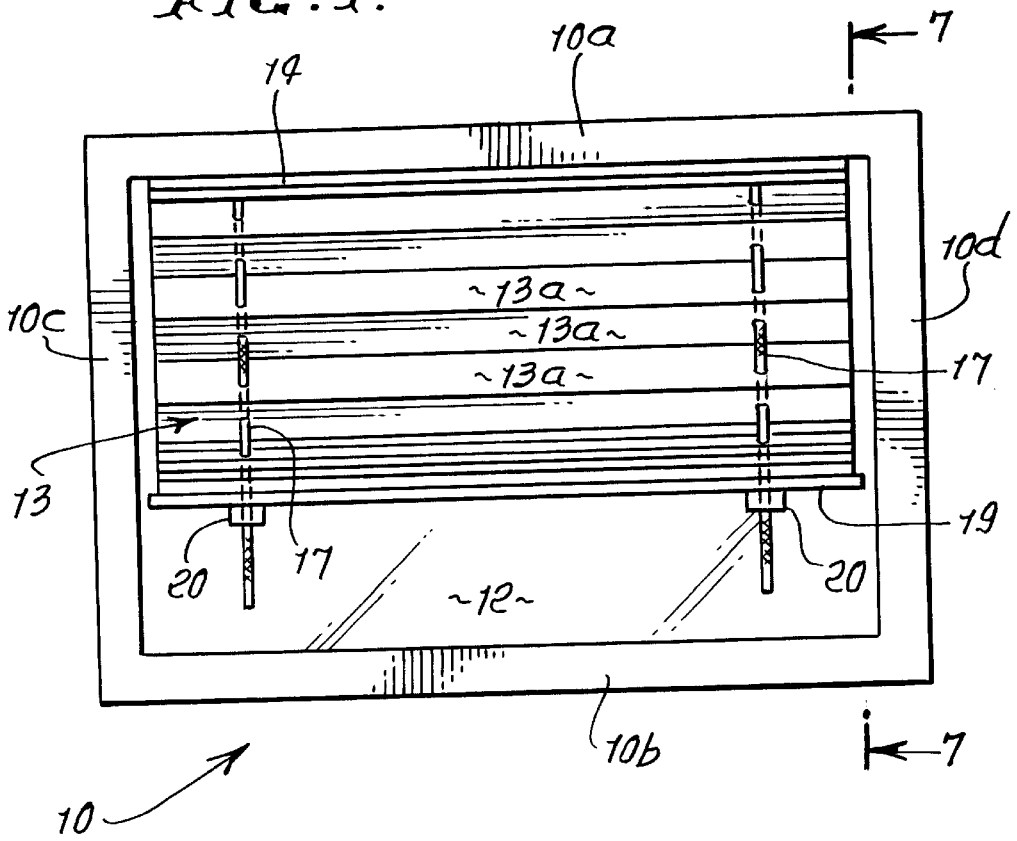
FIG. 1 is an elevation showing an adjustably supported window shade.

In FIG. 1, shade upper support structure is shown at 10, as in the form of a horizontal upper part 10*a* of a window frame. The frame also includes frame lower part 10*b*, and verticals at 10*c* and 10*d*. The window may for example include a glass pane 12.

A window shade or cover is shown at 13, and may include pleats 13*a*, which expand apart to extend diagonally back and forth, when the shade is hung. An upper shade support structure is located at or proximate the shade top. See for example horizontal slat 14 the upper side of which may be attached to the frame part 10*a*, as for example by tape having adhesive at its opposite sides.

Figure 7:
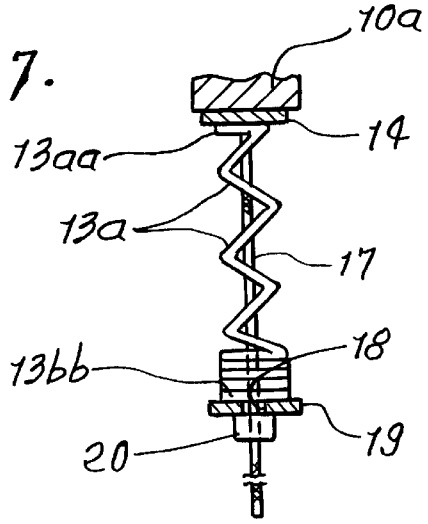
FIG. 7 is an end elevation taken on lines 7—7 of FIG. 1.

At least one, and preferably two support lines or cords 17 are suspended from slat 14, the two illustrated lines 17 being spaced apart horizontally. Those lines pass downwardly through holes in the pleats, as seen in FIG. 7, and they also pass downwardly loosely through holes or openings 18 in a shade lower support structure located at or proximate the shade bottom. See FIGS. 2 and 4. As shown, the lower support structure comprises a horizontally elongated lower slat 19. The uppermost pleat 13*aa* may be attached to the underside of the upper slat 14; and the lowermost pleat 13*bb* may be attached to the upper side of the lower slat 19. The attachments may be made by use of dual adhesive sided tape.

The shade height may therefore be adjusted by manually elevating or lowering the lower slat 19, relative to the line or lines 17, and securing it in adjusted position.

Figure 2:
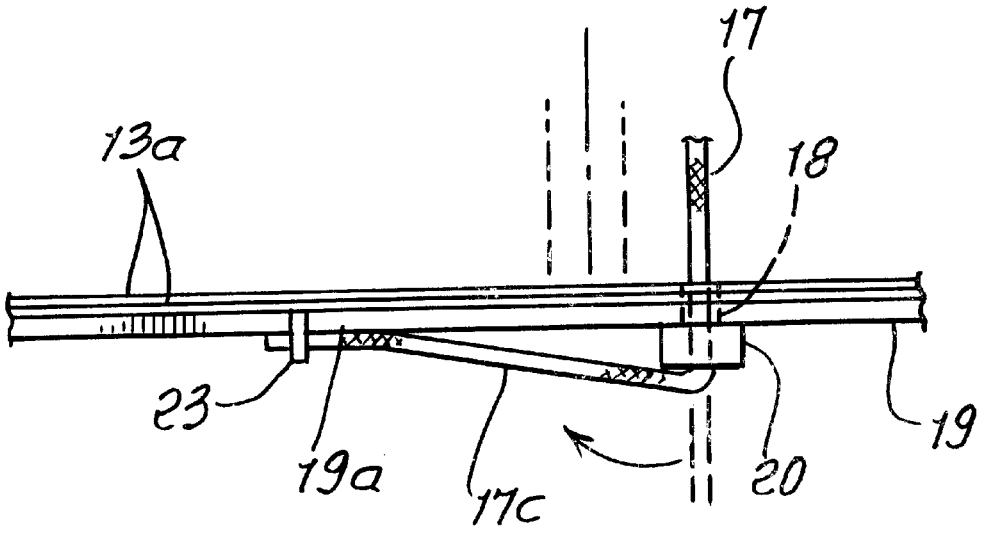
FIG. 2 is an enlarged elevational view, showing use of a stop, capable of adjustment along a support line.
Figure 3:
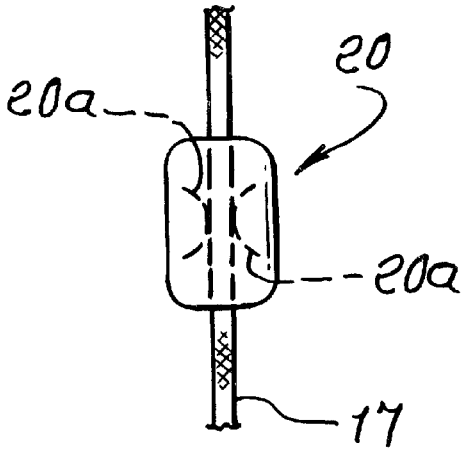
FIG. 3 is a view showing stop structure.

Such securing is preferably made by adjusting a stop or stops 20 on the line or lines 17, whereby the lower slat 19 is held in selected elevated position by those stops 20. As shown in FIG. 2, the slat 19 seats on stop or stops 20, and the dangling lower extent 17*c* of the line 17 below the stop may be secured to the underside 19*a* of slat 19, as by tape or other means 23.

Stop 20 may have one or more grip jaws 20*a* wedged against the line 17, as by a spring, to frictionally hold the stop in position, spaced below the shoulder pleats. One jaw may be pushed to release jaw grip of the line, enabling stop adjustment along the line. Accordingly, the pleats are not disturbed by any pleat holding element, to maintain their attractive appearance.

Figure 4:
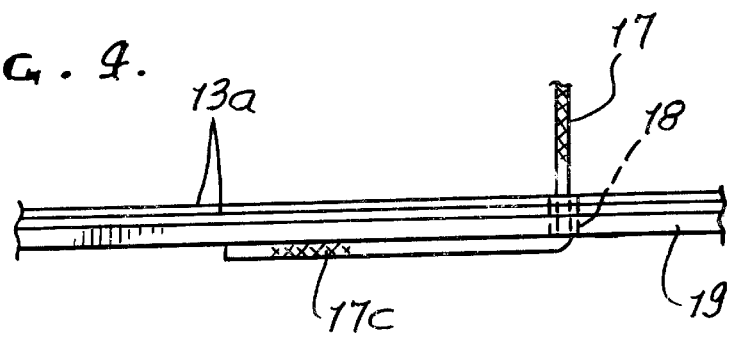
FIG. 4 is an enlarged view showing another method of shade support adjustment, relative to a line.
Figure 5:
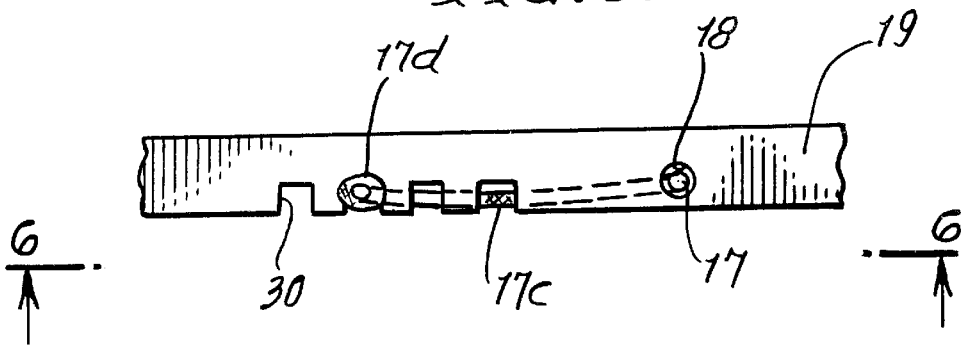
FIG. 5 is a plan view showing line connection to a slat, with notches.
Figure 6:
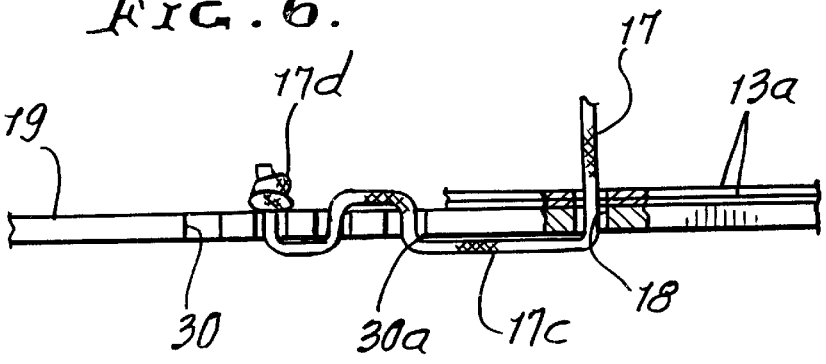
FIG. 6 is a side elevational view taken on lines 6—6 of FIG. 5.

In FIG. 4, the stop 20 is eliminated, and line extent 17*c* below the hole 18 in the slat is turned laterally and attached to the slat, thereby blocking downward travel of the slat relative to the line. FIGS. 5 and 6 show one means of attaching the line extent 17*c* to the slat. Slots 30 are provided in the slat along its length, the line 17*c* is wound into the slots to engage slot shoulders 30*a*, to frictionally retain the line to the slat. Quick removal of the line extent 17*c* from the slots is thereby enabled, to facilitate upward or downward adjustment of the lower slat relative to the line or lines 17. A knot 17*d* may be provided at the end of line 17 to be captured in a selected slot 30.

We claim:

1. The method of controlling the vertical height of a window shade having a top and bottom, and pleats therebetween which includes the steps a) providing shade upper support structure at or proximate the shade top, b) providing at least one substantially vertically elongated shade support line extending downwardly from said upper support structure, c) and providing shade lower support structure in the form of a substantially horizontally extending slat for supporting pleats gathered or gathering at or proximate the shade bottom, d) elevating or lowering said shade lower support structure relative to said one or more support lines, e) and effectively securing said shade lower support structure to the line or lines at a selected height position relative to the line length above said lower support structure, by providing a stop or stops directly below said slat and through which said line or lines extends and by which said line or lines are adjustably gripped by a stop jaw or jaws, f) and adjusting said stop or stops lengthwise of said line or lines to effect said elevating and lowering whereby the height of the shade bottom can be quickly manually adjusted by adjustment of the height of the shade lower support structure effective securement to said line or lines via said stops.

2. The method of claim 1 wherein said shade is provided in the form of a sequence of said pleats, and said line or lines is or are located adjacent said pleats and passing through said pleats at locations in vertical alignment with said stop or stops.

3. The method of claim 1 wherein weight imposed by the lowermost pleats of the shade is carried by said shade lower support structure as said lower support structure is elevated to shorten the height of the shade, said stop or stops line gripping jaws being positioned to be manually pushed to release gripping of the line or lines to enable stop travel along said line or lines.

4. The method of claim 1 wherein lowermost extend of the line or lines is or are extended below said lower support structure, and stops, and including supporting said lowermost extent of the line or lines at a location or locations characterized in that said lowermost extent of the line or lines remains extended.

5. The method of claim 4 wherein said supporting of said line dangling lowermost extent or extents is effected by attachment to said lower support structure.

6. The method of claim 5 including providing attachment shoulders on said lower support structure, and said attachment is effected by frictional engagement with at least one of said shoulders of said line dangling lowermost extent.

7. The method of claim 6 wherein said shoulders are provided in the form of slots in said lower support structure.

8. The method of claim 6 wherein said lower support structure is provided in the form of an elongated slat.

9. The method of claim 1 wherein said stop or stops gripping jaw or jaws have slidable engagement with and being adjustable along the line length in response to manual pushing of the jaw or jaws.

* * * * *